US012050073B2

(12) United States Patent
Schrödl

(10) Patent No.: US 12,050,073 B2
(45) Date of Patent: Jul. 30, 2024

(54) FIRING PIN SAFETY OF A FIREARM

(71) Applicant: SAKO OY, Riihimäki (FI)

(72) Inventor: Christoph Schrödl, Porvoo (FI)

(73) Assignee: SAKO OY, Riihimäki (FI)

( * ) Notice: Subject to any disclaimer, the term of this patent is extended or adjusted under 35 U.S.C. 154(b) by 0 days.

(21) Appl. No.: 17/922,965

(22) PCT Filed: May 20, 2021

(86) PCT No.: PCT/EP2021/063477
§ 371 (c)(1),
(2) Date: Nov. 2, 2022

(87) PCT Pub. No.: WO2021/234093
PCT Pub. Date: Nov. 25, 2021

(65) Prior Publication Data

US 2023/0152052 A1 May 18, 2023

(30) Foreign Application Priority Data

May 20, 2020 (FI) ..... 20205510

(51) Int. Cl.
*F41A 17/66* (2006.01)
*F41A 11/00* (2006.01)

(52) U.S. Cl.
CPC ..... *F41A 17/66* (2013.01); *F41A 11/00* (2013.01)

(58) Field of Classification Search
CPC ..... F41A 17/64; F41A 17/66; F41A 17/70; F41A 17/74; F41A 17/76; F41A 17/80
(Continued)

(56) References Cited

U.S. PATENT DOCUMENTS 3,648,562 A * 3/1972 Loeble ..... F41A 19/13 89/185
6,145,234 A 11/2000 Fluhr
(Continued)

FOREIGN PATENT DOCUMENTS

DE 319321 C 3/1920
FI 128200 B 12/2019
WO WO-2020115367 A1 * 6/2020 ..... F41A 17/66

OTHER PUBLICATIONS

International Search Report and Written Opinion in Application No. PCT/EP2021/063477, mailed Sep. 10, 2021, 12 pages.
(Continued)

*Primary Examiner* — Bret Hayes
(74) *Attorney, Agent, or Firm* — Meunier Carlin & Curfman LLC

(57) ABSTRACT

The invention relates to a firing pin safety of a firearm, which firearm comprises a firing pin safety, a hammer, a bolt, a bolt carrier, and a firing pin, in which the firing pin safety comprises a safety lever mounted on a bolt carrier of the firearm, which firing pin safety is configured to control movement of a firing pin of the firearm. The safety lever and the hammer are integrated functionally, the safety lever is turnable and has three main positions: a basic position, in which position the safety lever retains movement of the firing pin to a primer of a cartridge and from inside the bolt, a release position, in which the safety lever actuated by the hammer releases movement of the firing pin towards the primer of the cartridge but not from inside the bolt, and a dismantle position, in which position the safety lever of the firing pin safety can be dismantled and the firing pin can be removed manually from inside the bolt of the firearm without tools.

11 Claims, 14 Drawing Sheets

(58) Field of Classification Search
USPC ..... 42/70.08
See application file for complete search history.

(56) References Cited

U.S. PATENT DOCUMENTS

| | | | | |
|---|---|---|---|---|
| 6,886,285 | B1 | 5/2005 | Sirkis et al. | |
| 8,245,427 | B2 | 8/2012 | Gomez | |
| 2011/0162248 | A1 | 7/2011 | Trpcic | |
| 2017/0003093 | A1 | 1/2017 | Spinner et al. | |
| 2017/0307320 | A1* | 10/2017 | Bailey | F41A 17/74 |
| 2018/0164057 | A1* | 6/2018 | Steimke | F41A 3/82 |

OTHER PUBLICATIONS

Finnish Search Report in Finnish Application No. 20205510, dated Dec. 17, 2020, 1 page.

* cited by examiner

FIRING PIN SAFETY OF A FIREARM

CROSS REFERENCE TO RELATED APPLICATIONS

This application is a United States National Phase Patent Application of International Patent Application Number PCT/EP2021/063477, filed on May 20, 2021, which claims the benefit of priority to FI Application No 20205510, filed on May 20, 2020.

TECHNICAL FIELD

The present invention relates to firing pin safeties for firearms, especially for automatic and semi-automatic firearms. More precisely the present invention 15 relates to a firing pin safety of a firearm according to the preamble part of claim 1.

BACKGROUND

One problem in firearms, usually in semi-automatic or automatic firearms, is a slamfire, which is a premature, unintended discharge of a firearm and which typically may occur, when a bolt of the firearm stops rapidly, while a firing pin continues its movement by inertia forward and hits and sets off a primer. Sometimes, the firing pin only causes a dent onto the primer but in the worst cases the slamfire occurs. Typically, the slamfire is prevented by providing the firing pin with a spring around it for slowing down the movement but in all cases the spring is not effective enough as the force of the spring is not enough to prevent the continuation of the movement of the firing pin. In case one should try to prevent the continuation of the movement of the firing pin in order to prevent the slamfire by increasing preventing force of the spring, it would also mean that the force of the striking hammer should also be increased, which may then cause subsequent problems in the firearm.

The firing pin may also move if the firearm is dropped by the user and the tip of the firing pin strike the primer of the ammunition inadvertently, which may even cause an accident.

In US patent publication 6,145,234 is disclosed a firearm comprising a breechblock, a firing pin having a tip, a proximal end opposite the tip and a catch surface disposed in proximity to the proximal end, a hammer which is movable from a loaded position through a motion path to strike the firing pin, a firing pin spring biasing the firing pin into a rest position wherein the tip of the firing pin is adapted to be spaced from a percussion cap of a cartridge and a one-piece leaf spring including a spring arm supported on the breechblock, a safety catch disposed in proximity to the proximal end of the spring arm and having a first position wherein the safety catch engages the catch surface to secure the firing pin in the rest position and a second position wherein the safety catch disengages the catch surface to release the firing pin for movement out of the rest position, the spring arm biasing the safety catch into the first position, and a beveled release part disposed adjacent the proximal end of the spring arm, the beveled release part having a camming surface disposed within the motion path of the hammer when the safety catch is in the first position such that, as the hammer moves from the loaded position through the motion path, the hammer cams the camming surface of the beveled release part against the force of the spring arm to move the safety catch from the first position to the second position, and the hammer then strikes the proximal end of the firing pin to displace the firing pin from the rest position.

In US patent publication 8,245,427 is disclosed a firearm, firing pin safety catch mechanism comprising a bolt having a face and proximal end for receiving a firing pin, a bolt carrier, a firing pin having a distil end, a proximal end opposite the distil end and a recess, or catch surface, disposed in proximity to the proximal end, a hammer which is moveable from a cocked position through a travel path to make contact with the firing pin, a firing pin spring biasing the firing pin into a rest portion wherein the distil end of the firing pin is designed to be spaced from the forward face of the bolt and a safety catch mechanism including a safety catch supported on the bolt carrier, rotating on a pin which is biased by a spring at one end; a safety catch which is disposed in proximity to the proximal end of the safety catch mechanism and having a first position wherein the safety catch engages the recess and secures the firing pin in the rest position and a second position wherein the safety catch disengaged the recess thereby releasing the firing pin for movement out of the rest position, the spring biasing the safety catch into the first position; and a camming surface located at the proximal end of the safety catch mechanism, the camming surface disposed within the travel path of the hammer when the safety catch is in the first position such that, as the hammer moves from the cocked position through the travel path, the hammer cams the camming surface of the distil end of the safety catch thereby disengaging the safety catch from the first position to the second position, by overcoming the force being imparted to the safety catch mechanism by the spring, thus allowing the hammer to strike the proximal end of the firing pin thereby displacing the firing pin from its rest position.

An object of the present invention is to create a firing pin safety of a firearm by which the above described problems relating to the possible slamfire are eliminated.

Another object of the present invention is to create an improved firing pin safety of a firearm, in which slamfire is prevented automatically.

SUMMARY

In order to achieve the above objects and those that will come apparent later the firing pin safety of a firearm is mainly characterized by the features of the independent claims.

Dependent claims present advantageous features and embodiments of the invention.

According to the invention, the firing pin safety of a firearm, which firearm comprises a firing pin safety, a hammer, a bolt, a bolt carrier and a firing pin, in which the firing pin safety comprises a safety lever mounted on a bolt carrier of the firearm, which firing pin safety is configured to control movement of a firing pin of the firearm, wherein the safety lever and the hammer are integrated functionally, the safety lever is turnable and has three main positions: a basic position, in which position the safety lever retains movement of the firing pin to the primer of the cartridge and from inside the bolt, a release position, in which the safety lever actuated by the hammer releases movement of the firing pin towards the primer of the cartridge but not from inside the bolt, and a dismantle position, in which position the safety lever of the firing pin safety can be dismantled and the firing pin can be removed manually from inside the bolt of the firearm without tools.

According to an advantageous feature of the invention the hammer comprises a spring-loaded plunger configured to guide the safety lever of the firing pin safety.

According to an advantageous feature of the invention the hammer comprises a beveled surface configured to guide the safety lever of the firing pin safety.

According to an advantageous feature of the invention the safety lever comprises a bevel configured to provide turning of the safety lever.

According to an advantageous feature of the invention the firing pin comprises a breech head and the safety lever has form-fitting forms that correspond to form-fitting forms of the breech head of the firing pin configured to affect degrees of freedom of the firing ping subject to the position of the safety lever.

According to an advantageous feature of the invention the firing pin safety comprises a spring-loaded return plunger for returning the safety lever automatically to its basic position.

According to an advantageous feature of the invention the return plunger is locking the safety lever to the bolt carrier.

According to an advantageous feature of the invention the firing pin safety comprises ball bearing locking means configured to secure the safety lever in vertical direction by means of a ball recess in the bolt carrier.

According to an advantageous feature of the invention the firing pin safety comprises a return-spring for the firing pin and the firing pin comprises a groove for locking the spring by attachment of a last loop of the spring into the groove.

According to an advantageous feature of the invention the form-fitting forms of the safety lever comprise arch recesses and a shoulder part as well as a bearing surface and the form-fitting forms of the breech head of the firing pin comprise two shoulders and a recess between the shoulders.

According to an advantageous feature of the invention the safety lever of firing pin safety comprises a body provided with at least one on its outer surface extending inclined groove for dirt and/or dust removal.

According to an advantageous aspect of the invention the firing pin safety is integrated functionally and by the safety lever and its co-operation with the hammer of the firing pin based on the form-fitting positions' location, the safety lever has integrated slamfire-prevention and inadvertent firing pin movement-prevention.

By the firing pin safety according to the invention the slamfire is prevented. Also, the firing ping safety according to the invention prevents the movement of the firing pin even if the firearm would be dropped by the user and thus, the danger of the tip of the firing pin striking the primer of the ammunition inadvertently is eliminated and the safe use of the firearm is increased. The firing pin safety according to the invention is also user-oriented having good ergonomic properties and provides for the possibility of easy dismantle for cleaning and/or maintenance.

BRIEF DESCRIPTION OF THE DRAWINGS

In the following the invention and its advantages are explained in greater detail below in the sense of example and with reference to accompanying drawing, where In FIG. 1A is schematically shown an advantageous example of a firearm.

Figure 8:
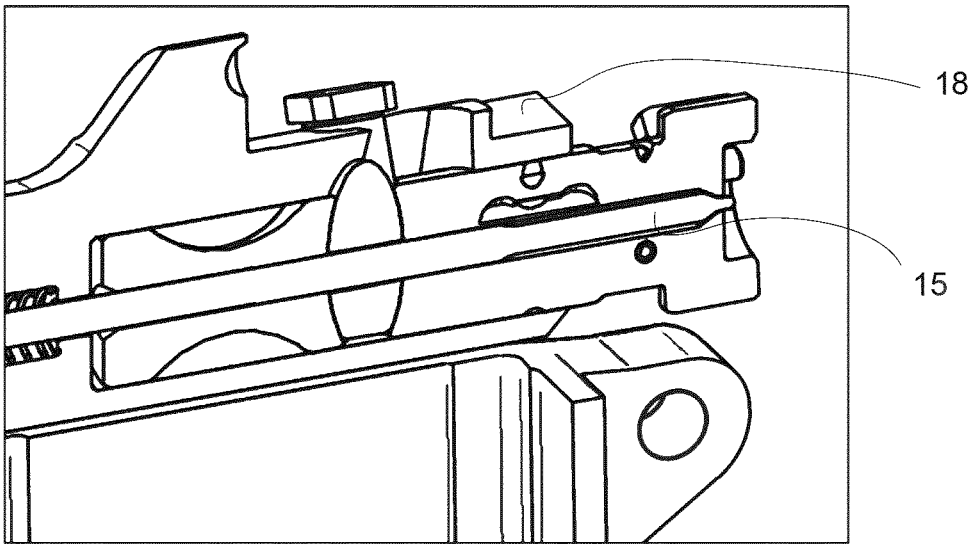

In the FIG. 8 is schematically shown an advantageous example of the firing pin safety according to the invention.

Figure 9:
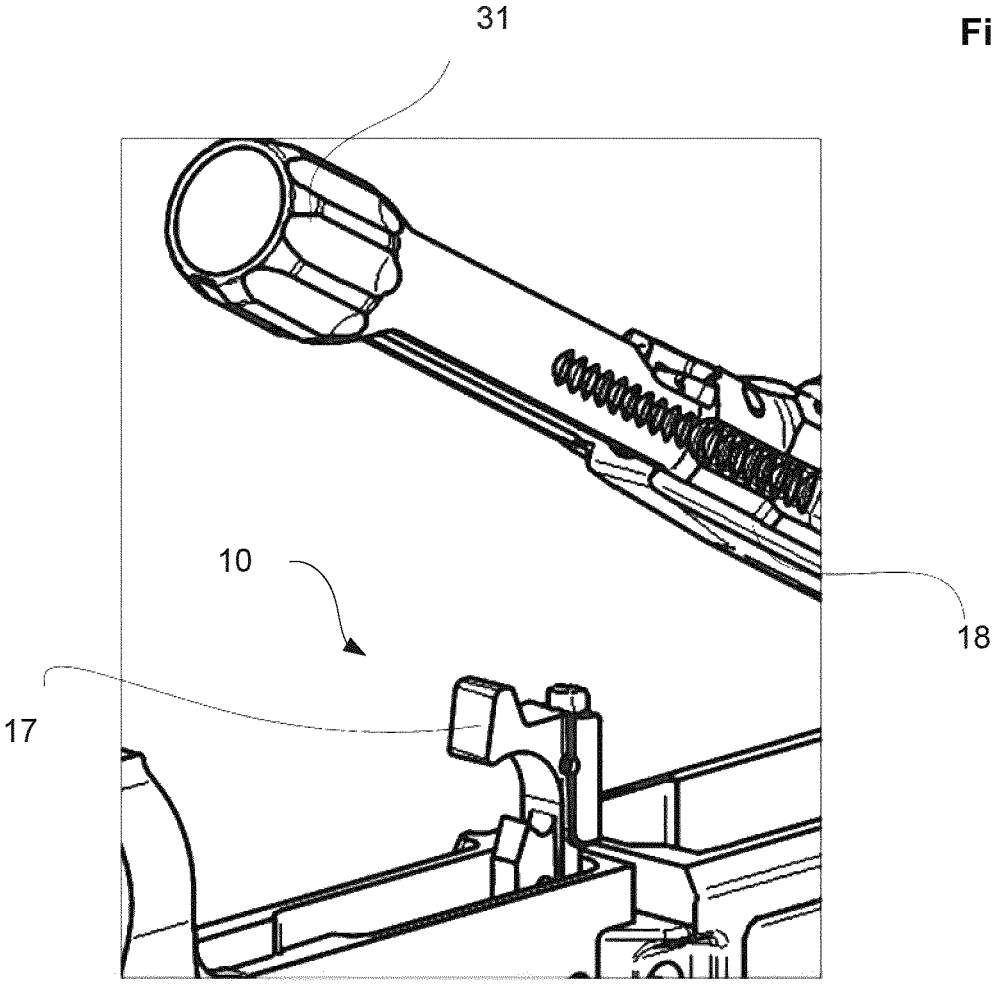

In FIG. 9 is schematically shown an advantageous example of the firing pin safety according to the invention.

Figure 10:
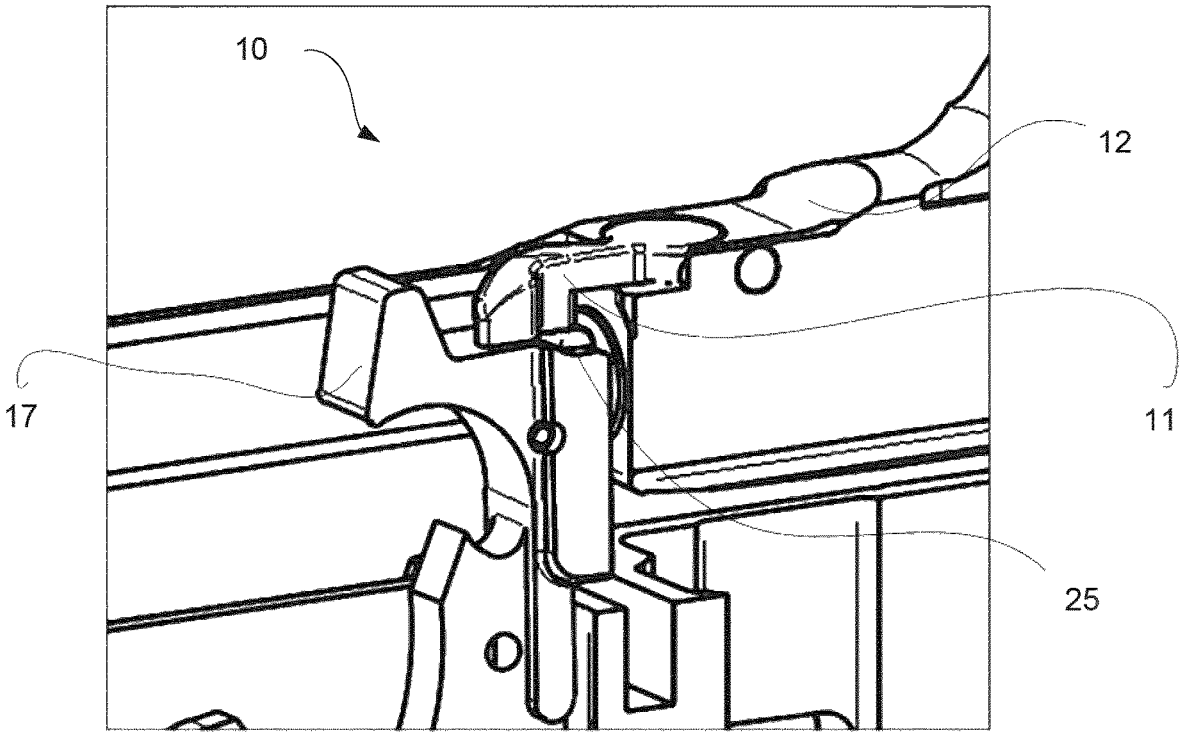

In FIG. 10 is shown the example of FIG. 9 as s sectional view.

Figure 11:
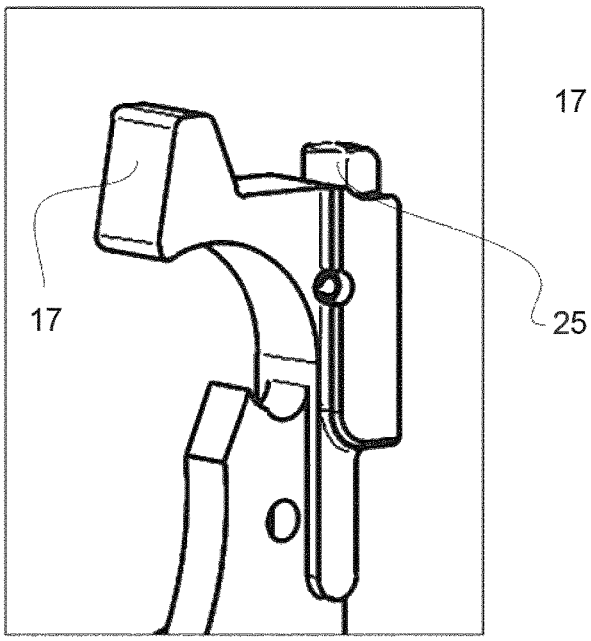
Figure 12:
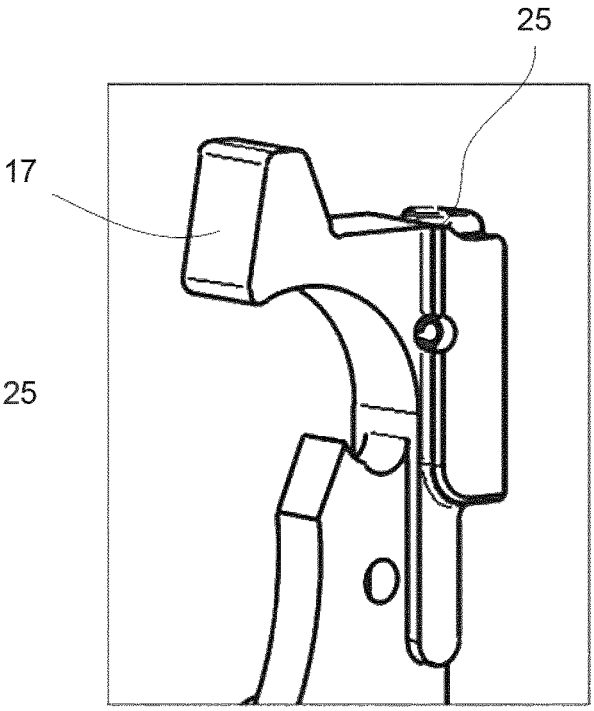

In FIGS. 11 and 12 is schematically shown an advantageous example of the firing pin safety according to the invention indicating movement of a spring-loaded plunger.

Figure 13:
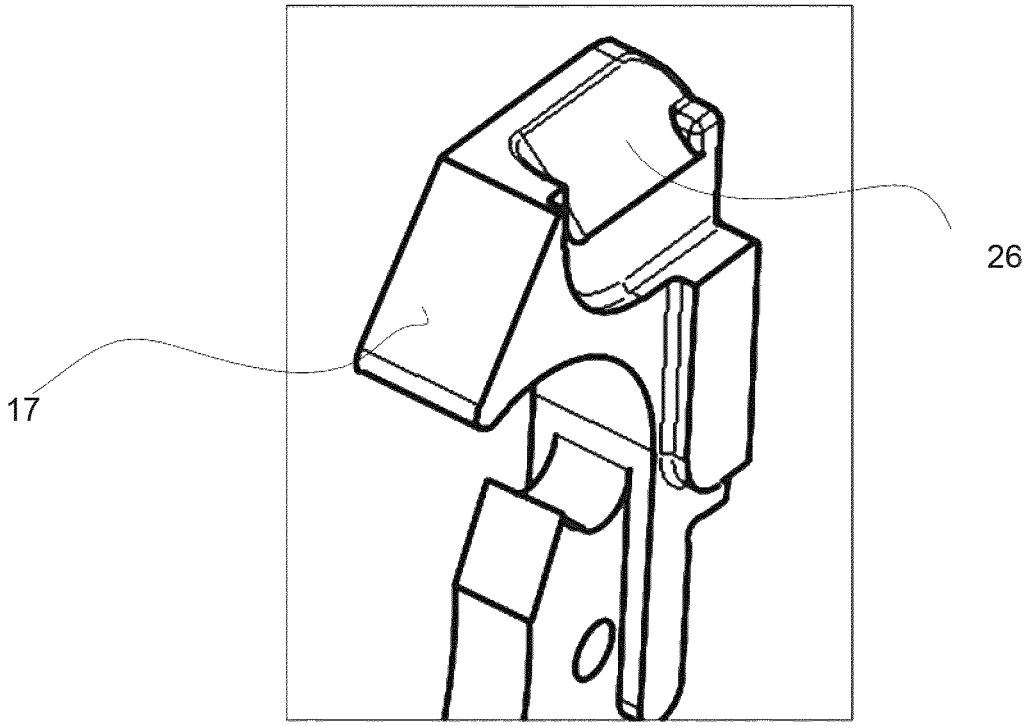

In FIG. 13 is schematically shown an advantageous example of the firing pin safety according to the invention.

Figure 14:
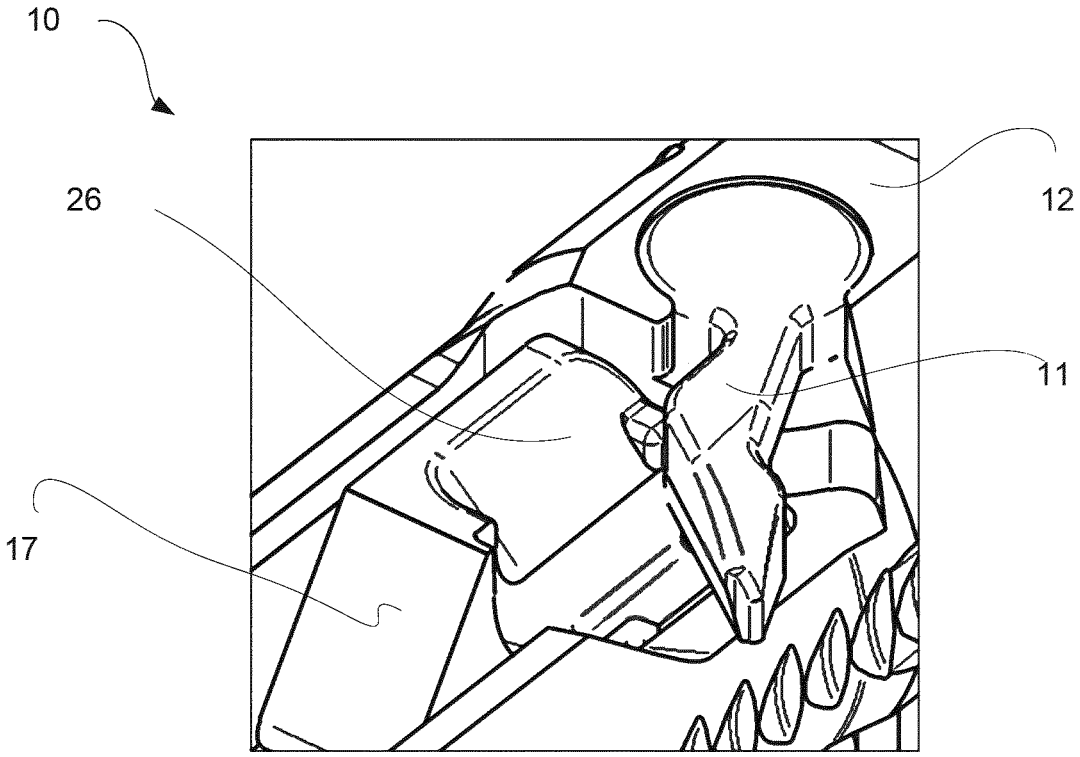

In FIG. 14 is schematically shown an advantageous example of the firing pin safety according to the invention.

Figure 15:
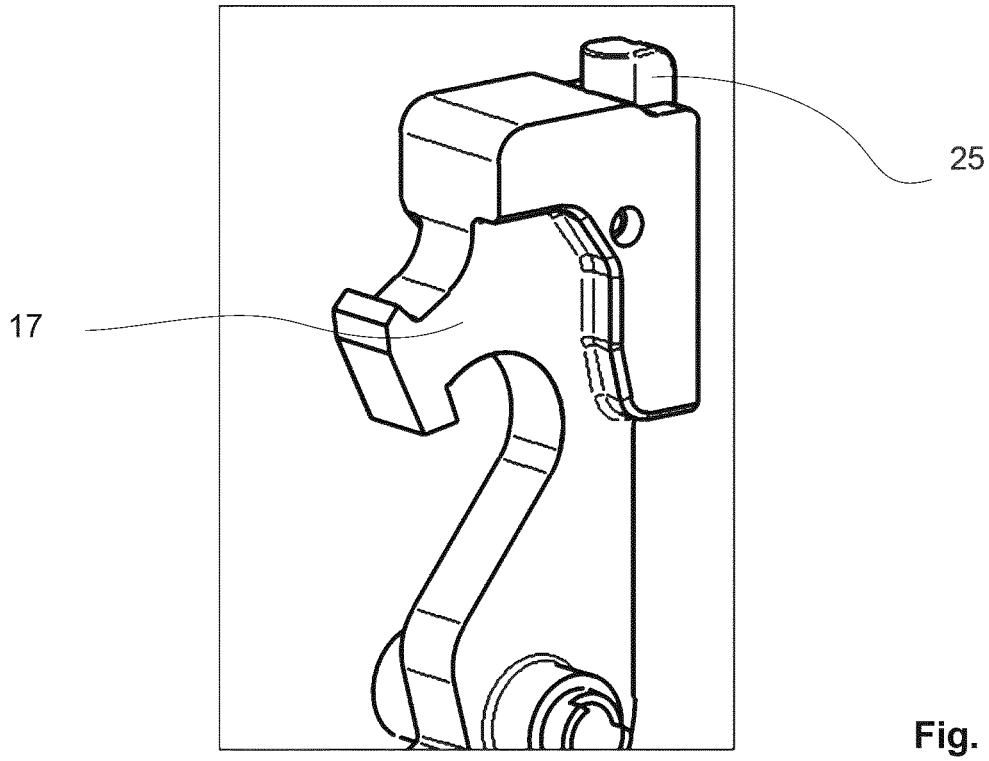

In FIG. 15 is schematically shown an advantageous example of the firing pin safety according to the invention.

Figure 16:
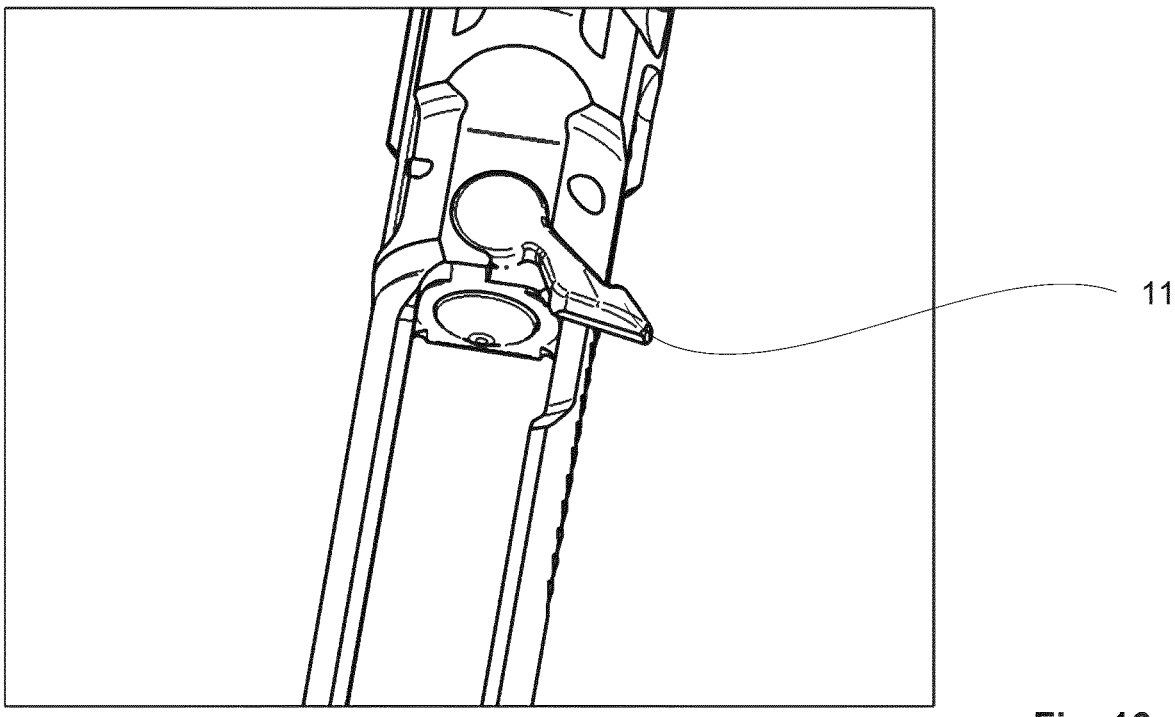

In the FIG. 16 is schematically shown an advantageous example of the firing pin safety according to the invention.

Figure 17:
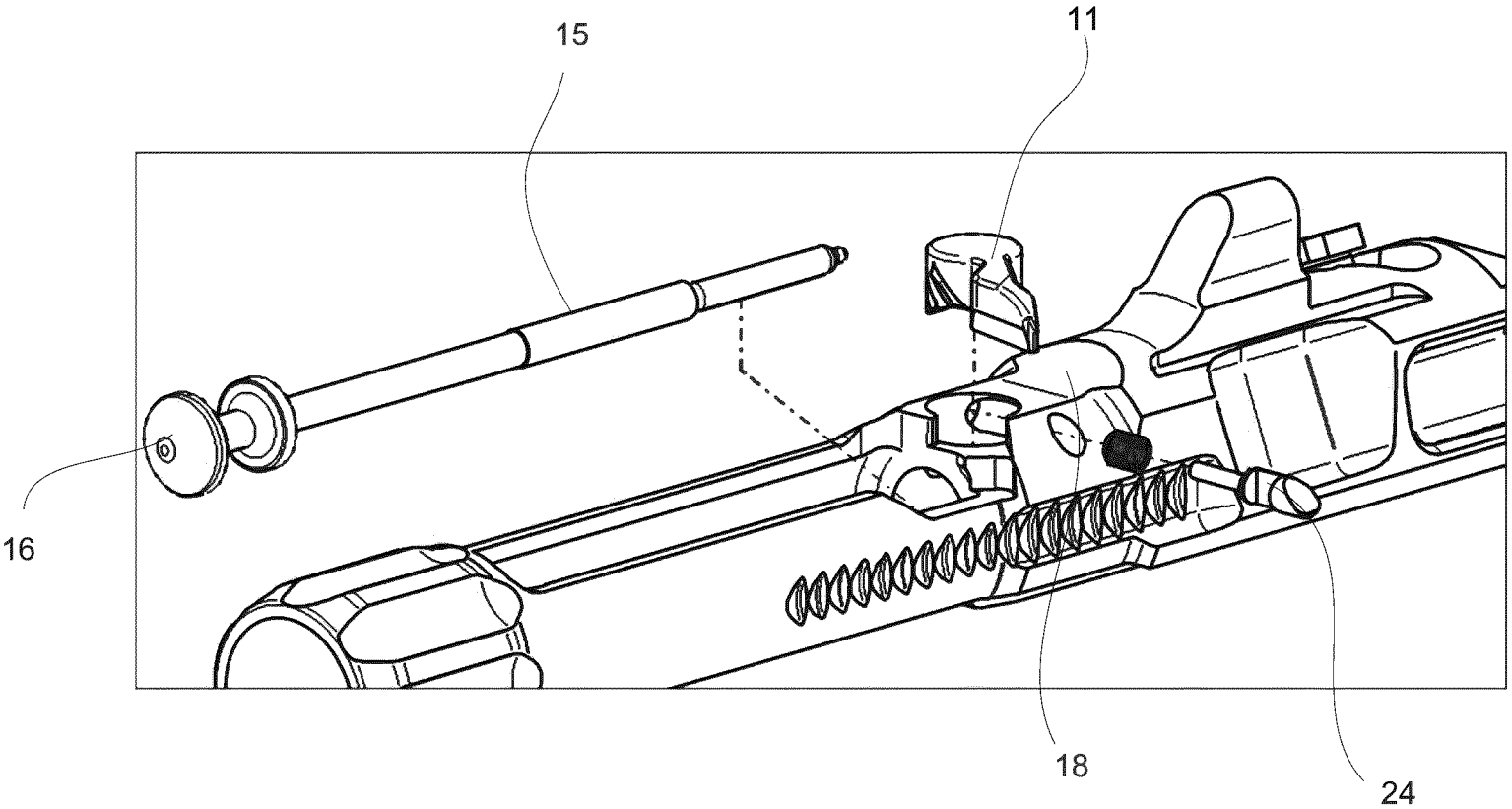

In FIG. 17 is schematically shown an advantageous example of the firing pin safety according to the invention in a dismantle position.

In FIGS. 18-22 is schematically shown an advantageous example of the firing pin and the safety lever in the different positions of the firing pin safety according to the invention.

In FIGS. 23-28 is schematically shown another advantageous example of the firing pin safety according to the invention.

DETAILED DESCRIPTION

During the course of the following description like numbers and signs will be used to identify like elements according to the different views which illustrate the invention and its advantageous examples. In the figures some repetitive reference signs may have been omitted for clarity reasons.

Figure 1A:
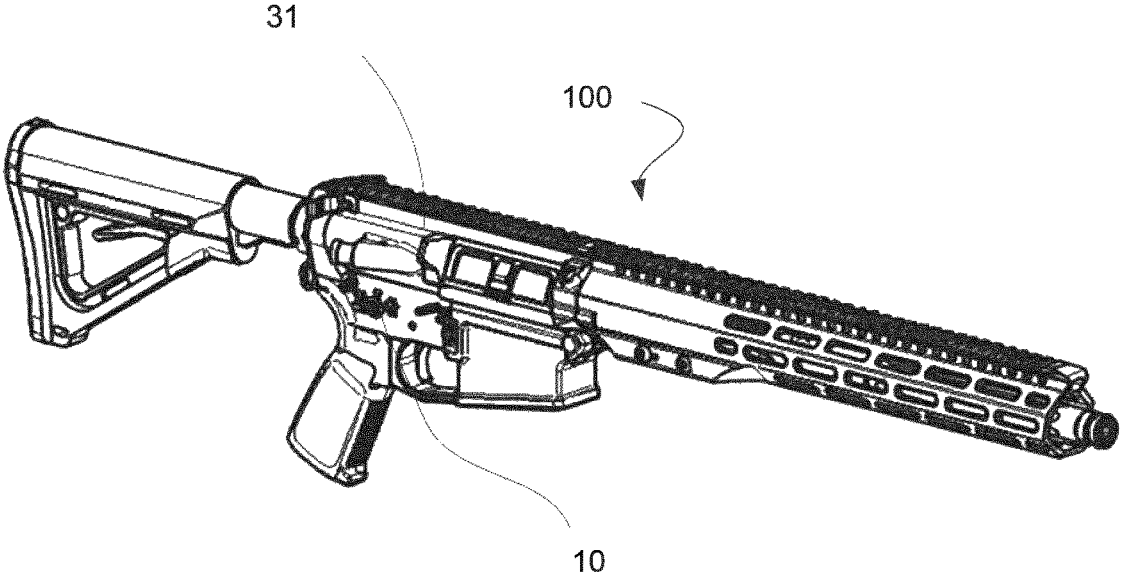
In FIGS. 1B-1C is schematically shown an advantageous example of a firing pin safety according to the invention.

In the FIG. 1A is shown an example of a firearm 100 comprising a firing pin safety below an upper body 31 of the firearm 100.

Figure 1B:
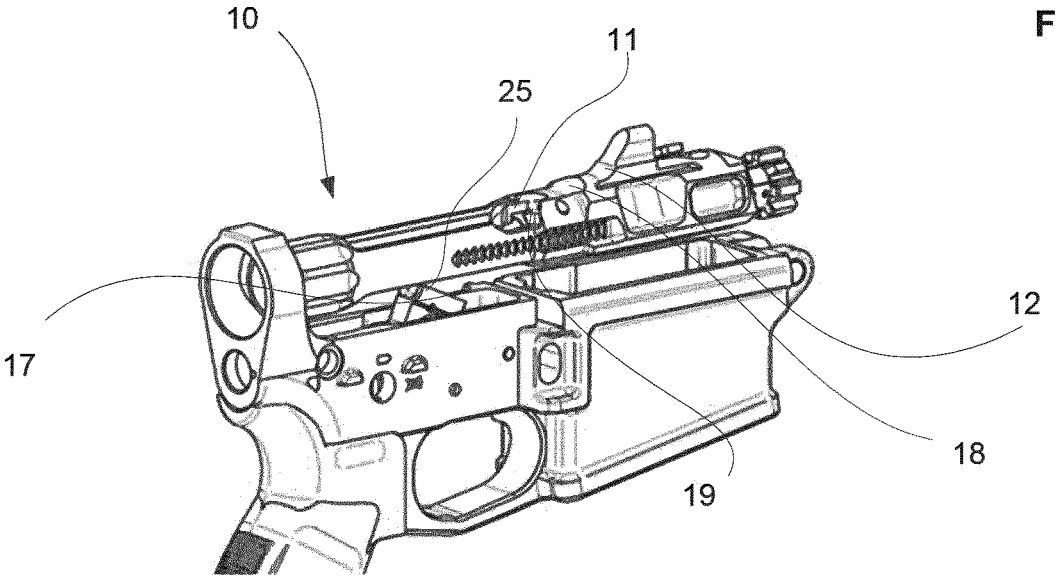
Figure 1C:
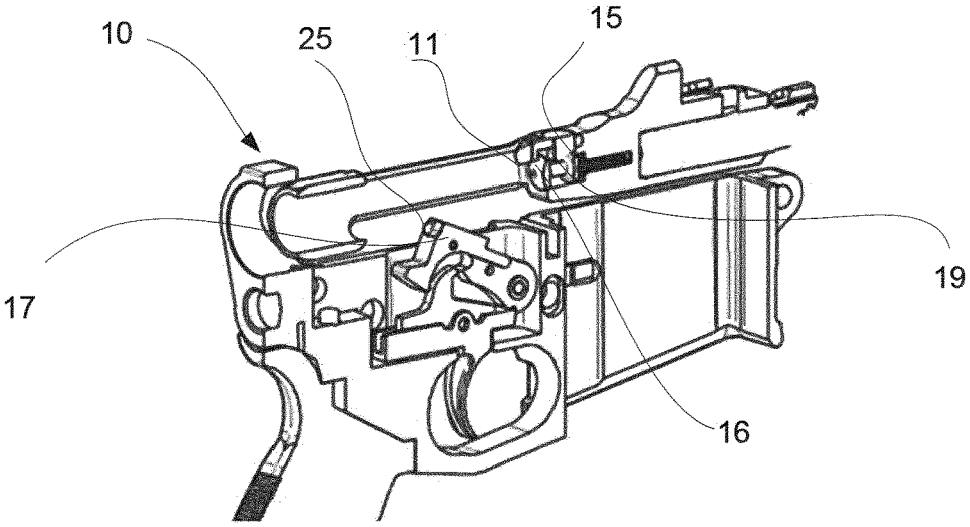

As shown in the example of FIGS. 1B-1C the firing pin safety 10 comprises a safety lever 11 with a bevel 19 attached to a bolt carrier 12 for a bolt 18 located around and for effecting the positions of a firing pin 15. The firing pin 15 has a breech head 16, to which an impact is caused by a hammer 17 for effecting position changes of the firing pin 15. In this example a spring-loaded plunger 25 is provided on top of the hammer 17 for guiding during firing the safety lever 11 of the firing pin safety 10 to side and enables back-turning closing the upper receiver with the hammer 17 in the discharged position.

Figure 2:
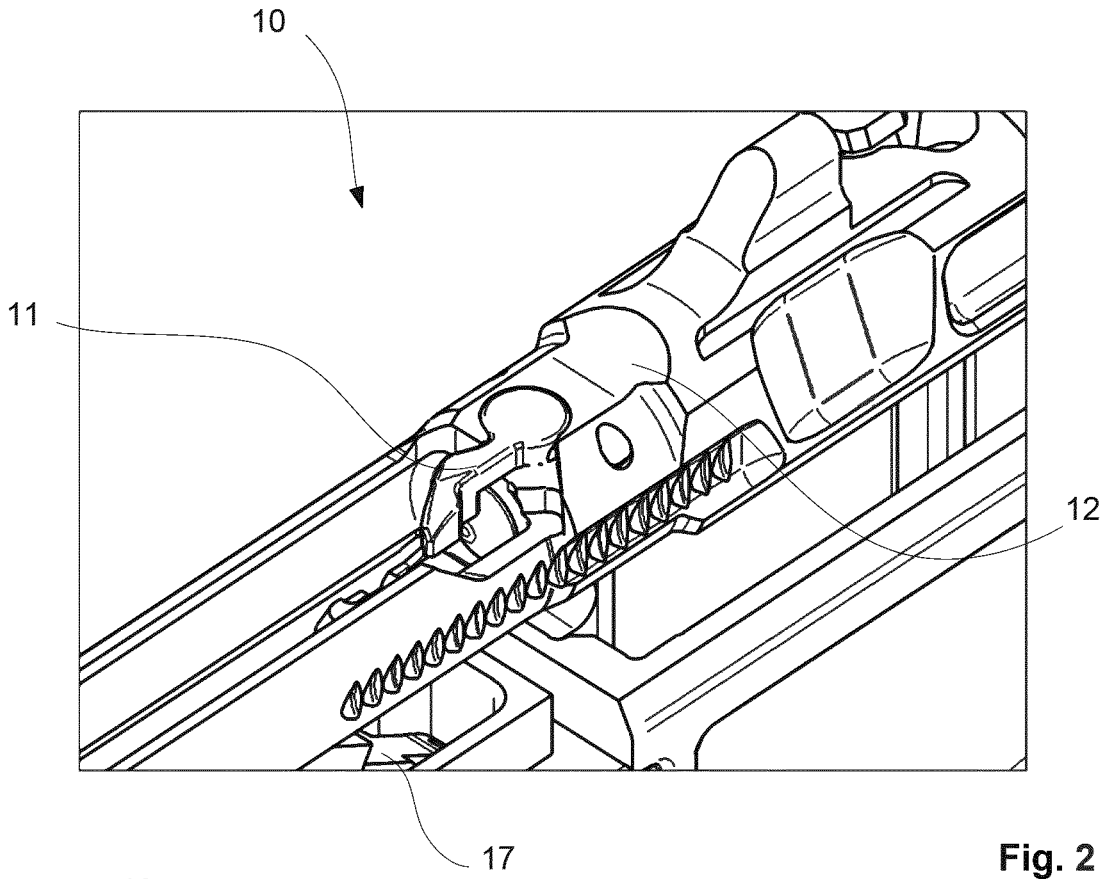
In FIG. 2 is schematically shown an advantageous example of a firing pin safety according to the invention.

In the FIG. 2 is shown an example of the firing pin safety 10. The firing pin safety comprises the safety lever 11 mounted on the bolt carrier 12. In the FIG. 2 the safety lever 11 is in a basic position, in which position it retains the movement of the firing pin 15 and the breech head 16 forwards such that the firing pin 15 cannot move freely nor meet a primer of an ammunition (not shown). The basic position is the default position of the safety lever 11 of the firing pin safety 10, to which default position the safety lever 11 of the firing pin safety tends to return from any other positions.

Figure 3:
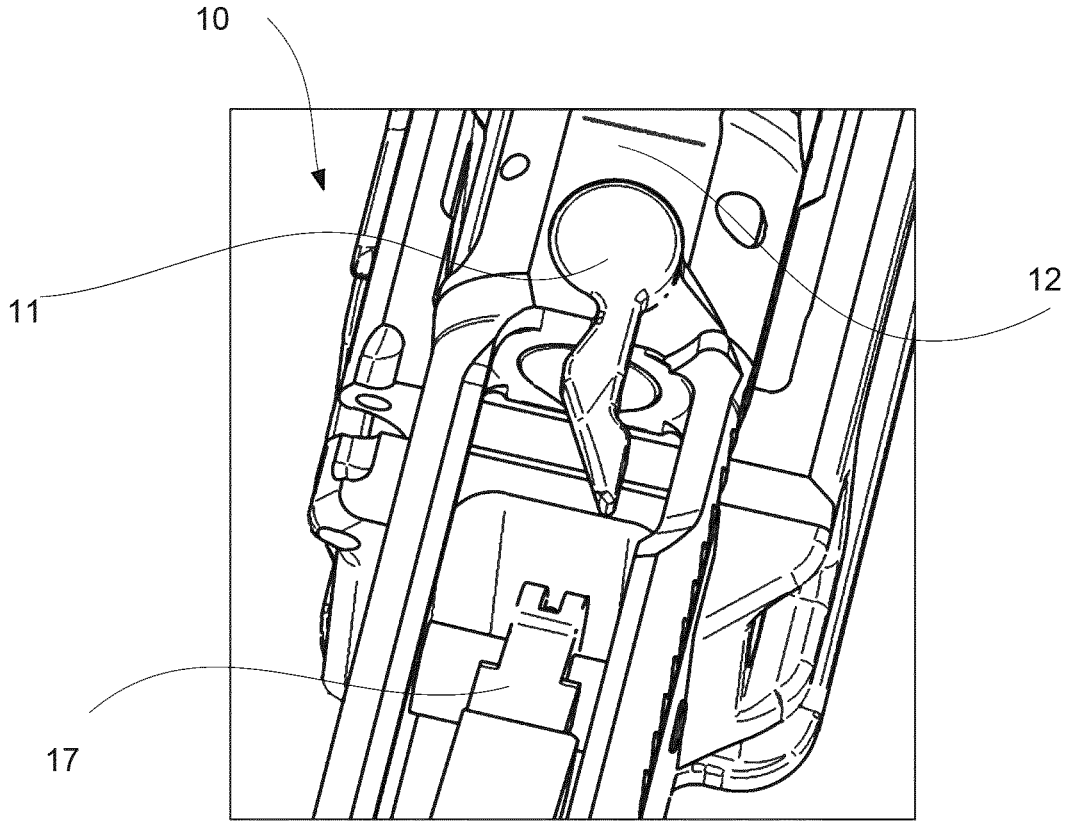
In FIG. 3 is schematically shown the example of FIG. 2 seen from above.

In the FIG. 3 is shown the example of FIG. 2 seen from above. In this example the safety lever 11 of the firing pin safety 10 is in the basic position i.e. in the default position to which the safety lever 11 of the firing pin safety 10 tends to return from any other positions. In the default position i.e. in the basic position the breech head 16 of the firing pin 15 extends outwards and the hammer 17 is cocked.

Figure 4:
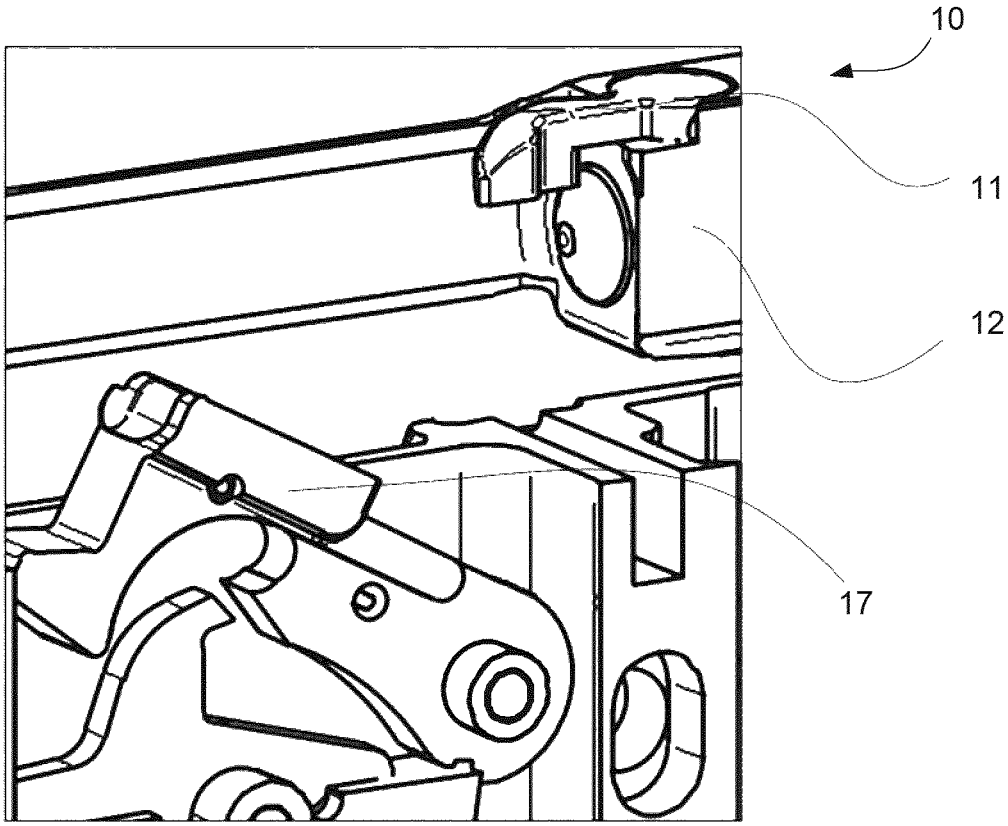
In FIG. 4 is schematically shown an advantageous example of the firing pin safety according to the invention in a basic position.

In the sectional view of the FIG. 4 is shown the position, in which the hammer 17 is armed and ready to strike the breech head 16 of the firing pin 15, as can be seen in the FIG. 4 below the safety lever 11 in protruded position. The safety lever 11 is in the basic position retaining movement of the firing pin 15.

Figure 5:
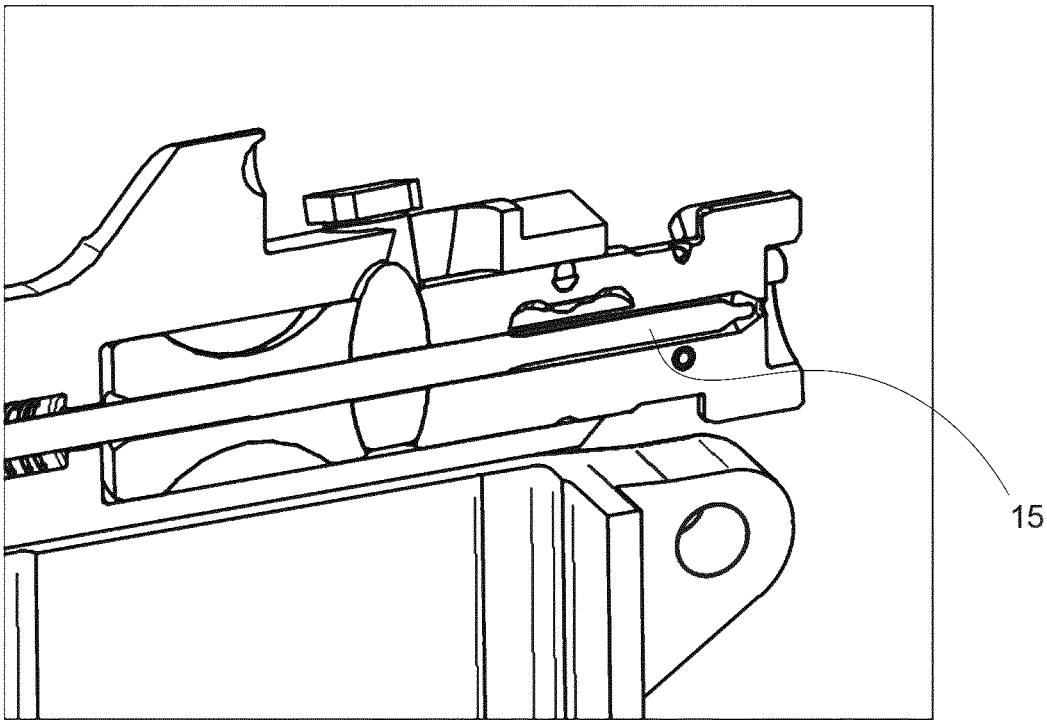
In FIG. 5 is schematically shown an advantageous example of the firing pin safety according to the invention with a firing pin in a back position.

In the example of the FIG. 5 the firing pin 15 is in a back position, in which the safety lever 11 of the firing pin safety 10 prevents protruding of the firing pin 15 out from the bolt 18.

Figure 6:
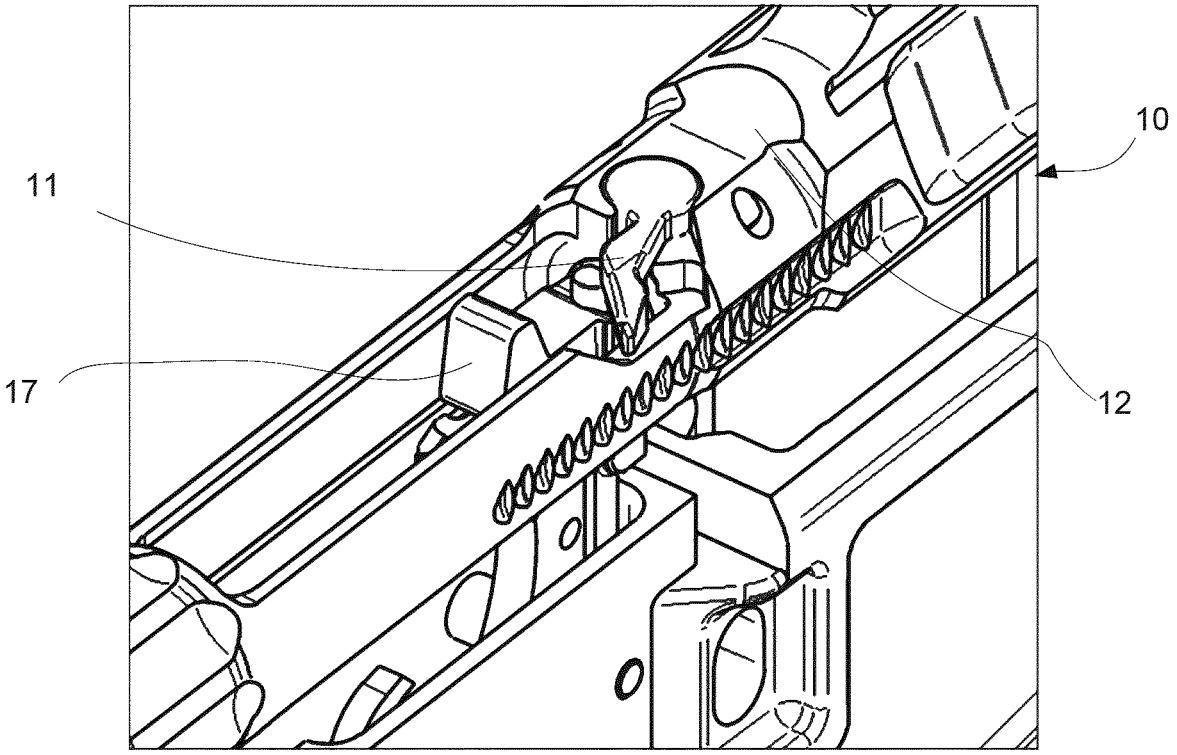
In FIG. 6 is schematically shown an advantageous example of the firing pin safety according to the invention in a release position, when a firearm is fired.

In the example of the FIG. 6 the firearm is discharged and the hammer 17 strikes the breech head 16 of the firing pin 15. Before meeting the breech head 16 the hammer 17 turns the safety lever 11 of the firing pin safety 10 to right in the figure and releases movement of the firing pin 15 such, that the firing pin 15 can strike the primer of the ammunition (not shown). Now the safety lever 11 of the firing pin safety 10 is in a release position.

Figure 7:
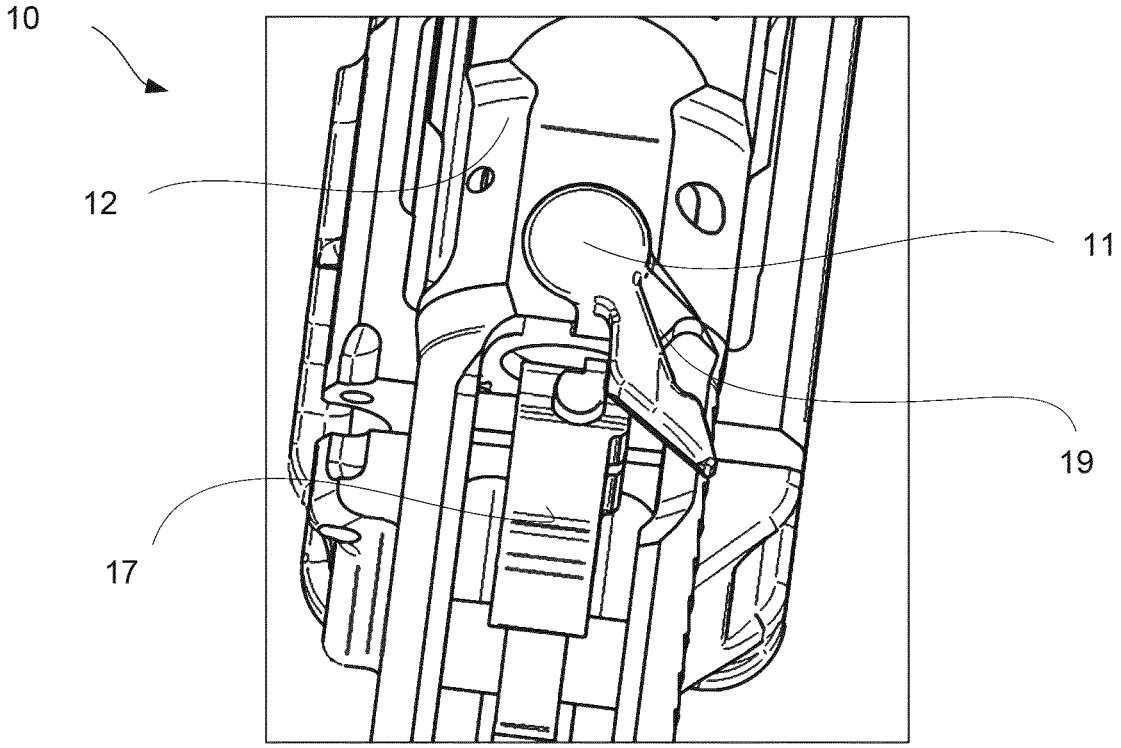
In FIG. 7 is shown the example of FIG. 6 seen from above.

In the FIG. 7 is shown the example of FIG. 6 seen from above. The safety lever 11 of the firing pin safety 10 has turned due to the movement of the hammer 17 to the release position and released the movement of the firing pin 15. The safety lever 11 meets the hammer 17, which provides the turning of the safety lever 11 to the side. At the end of the movement the hammer 17 strikes the breech head 16 of the firing pin 15 and the firearm is discharged.

As can be seen from the example of the FIG. 8 the firing pin 15 has a movement frontwards and protrudes out from the bolt 18.

In the example of the FIG. 9 an upper receiver (not shown) of the firearm 10 has been turned open with the hammer 17 in a discharged position as the hammer 17 has returned to the front position. The spring-loaded plunger 25 on top of the hammer 17 guides during firing the safety lever 11 of the firing pin safety 10 to side and enables back-turning closing the upper receiver with the hammer 17 in the discharged position.

In the sectional view of the example of the FIG. 10 the upper body 31 has been set down and the spring-loaded plunger 25 on top of the hammer 17 moves down with the down-setting of the upper body 31 during its final stages. The evasive means provided by the spring-loaded plunger 25 prevent the hammer 17 to collide with the safety lever 11 during down-setting of the upper body 31. When the firearm is loaded the hammer 17 slides backwards against bottom surface of the safety lever 11 of the firing pin safety 10 and returns to full upper position, when it has slid off from below the safety lever 11. Thus, the position is the same as in the stage, where the firearm is cocked, and the hammer 17 with the spring-loaded plunger 25 is functionable for the movement of the safety lever 11 of the firing pin safety 10 to side.

In the examples of the FIGS. 11 and 12 the spring-loaded plunger 25 moves downwards in the hammer 17 and tends to return to the upper position of the FIG. 11, in which it functions as turning means for the safety lever 11 of the firing pin safety 10, as well as the spring-loaded plunger 25 functions as the evasive means during down-setting of the upper body 31, as can be seen from the FIG. 12.

As can be seen from the example of the FIG. 13 as the evasive means for the hammer 17 also an in upper edge beveled surface 26 can be used, along which beveled surface 26 the safety lever 11 of the firing pin safety 10 turns during down-setting of the upper body 31 and does not collide with the hammer 17. The right front corner of the hammer 17 functions during firing as the turning means for the safety lever 11 of the firing pin safety 10.

In the example of the FIG. 14 the hammer 17 with beveled surface as shown in the example of the FIG. 13 is shown during firing or after the down-setting of the upper body 31.

In the example of the FIG. 15 is shown the hammer 17 for a two-stage trigger mechanism comprising the spring-loaded plunger 25, which functions as the evasive means during down-setting of the body and as turning means for the safety lever 11 of the firing pin safety 10.

In the example of the FIG. 16 the bolt carrier 12 has been removed from the upper body 31 and the safety lever 11 of the firing pin safety 10 has been turned manually to an extreme position on right i.e. to a dismantle position, in which position the safety lever 11 of the firing pin safety 10 can be dismantled and the firing pin 15 is popping out automatically, because it is spring-loaded, and the firing pin 15 is removed from inside the bolt 18 without tools.

In the example of the FIG. 17 the safety lever 11 of the firing pin safety 10 is dismantled after being turned to the dismantle position for cleaning and/or maintenance and the firing pin 15 has been removed. The spring-loaded return plunger 24 is returning the safety lever 11 automatically to its basic position. The return plunger 24 is mechanically locking the safety lever 11 to the bolt carrier 12.

Thus, the safety lever 11 has three main positions: a basic position, in which position the safety lever 11 retains movement of the firing pin 15 to the primer of the cartridge (not shown) and from inside the bolt 18, a release position, in which the safety lever 11 actuated by the hammer 17 releases movement of the firing pin towards the primer of the cartridge not shown) but not from inside the bolt 18, and a dismantle position, in which position the safety lever 11 of the firing pin safety can be dismantled and the firing pin 15 can be removed manually from inside the bolt 18 of the firearm 100 without tools. The safety lever 11 has form-fitting forms that correspond to form-fitting forms of the breech head 16 of the firing pin and thus, by turning the safety lever 11 the positions are provided. The form-fitting forms can be configured of protrusions and/or grooves on the bottom surface of safety lever 11 and around the breech head 16. In the basic position the firing pin safety 10 must be positioned by the safety lever 11 to a position, in which movement of the safety pin 15 forward seen from the user point of view is prevented. The safety lever 11 also locks the movement of the safety pin 15 towards the user. In the basic position thus, movement of the safety pin 15 forward cannot be caused by force as the movement is prevented by the safety lever 11. The movement of the hammer 17 turns the safety lever 11 to release position and the safety pin 15 is enabled to move forward. In the dismantle position the safety lever 11 is turned sideways, turned right in the implementation of the figure and the locking of the safety pin 15 is released towards the user and thus the safety pin 15 can be dismantled.

In the FIGS. 18-22 is shown an example of the form-fitting forms of the breech head 16 of the firing pin 15 and the safety lever 11 in different positions of the firing pin safety. The breech head 16 of the firing pin 15 comprises first and second shoulders 32, 34 and a recess 33 in between the shoulders 32, 34. The safety lever 11 comprises a body 39 provided with two on its outer surface extending inclined grooves 36, 37 and a shoulder part 38 formed on the outer surface of the body 39 as well as a bearing surface 42 and two arch recesses, one arch recess 45A for release and one arch recess for dismantle 45B.

Figure 18:
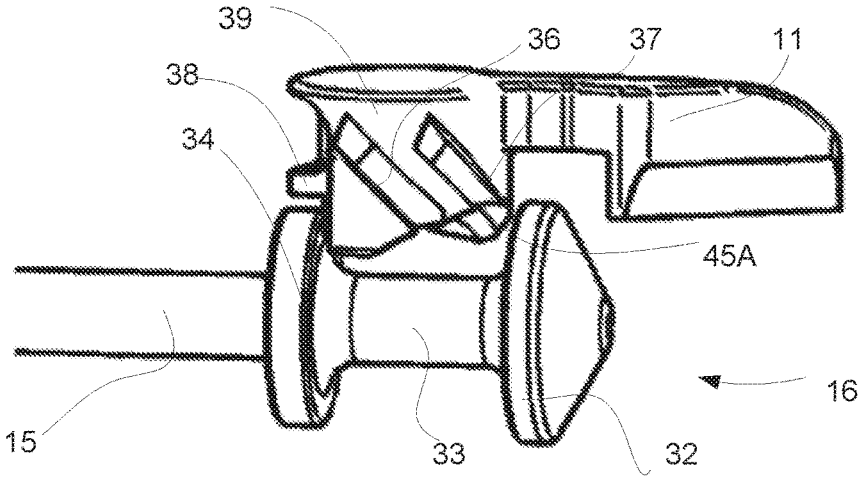

In FIG. 18 the safety lever 11 in respect to the breech head of the firing pin 15 is in the basic position, when the safety lever 11 retains movement of the firing pin 15 to a primer of a cartridge (not shown) and from inside the bolt 18. Thus, movements towards and away from the shooter are prevented. The form-fitting forms configured by the shoulder part 38 of the body 39 of the safety lever 11 and the second protrusion 34 of the breech head 16 of the firing pin 15 are in contact. The body of the safety lever 11 is located partially within the recess 33 between a first shoulder 32 and the second shoulder 34 of the firing pin 15.

Figure 19:
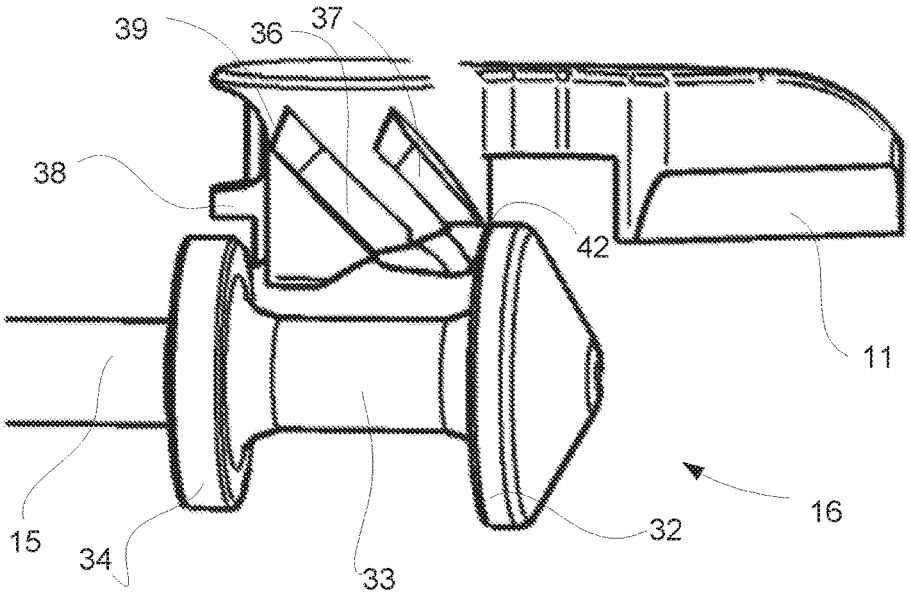

FIG. 19 shows the situation in the basic position in case the firing pin 15 is tried to be moved forwards and how the form-fitting forms of the safety lever 11 and the firing pin 15 prevent the movement, as the firing pin 15 rests with the shoulder 32 against a bearing surface 42 of the safety lever 11. Grooves 36, 37 are advantageously provided for dust and/or dirt removal.

Figure 20:
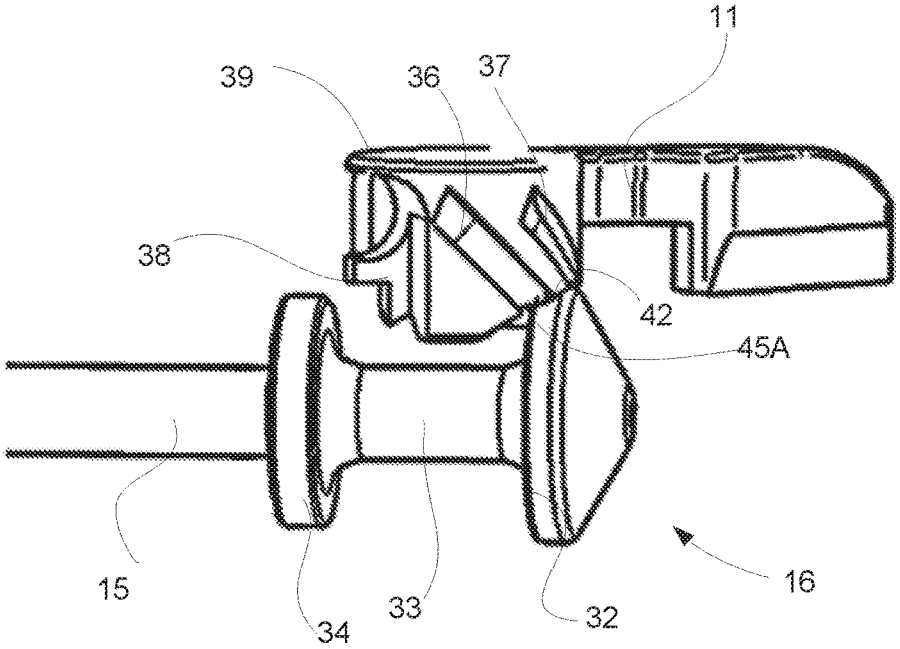

In FIG. 20 is shown the release position, in which the safety lever 11 actuated by the hammer 17 releases movement of the firing pin 15 towards the primer of the cartridge (not shown) but not from inside the bolt 18. The movement of the hammer 17 has moved the safety lever 11 to the release position, as the bearing surface 42 turns to the side—to the right in the example of the figure—and opens a form-fitting space by the release arch recess 45A for the first shoulder 32 to move and the firing pin 15 can freely move forwards.

Figure 21:
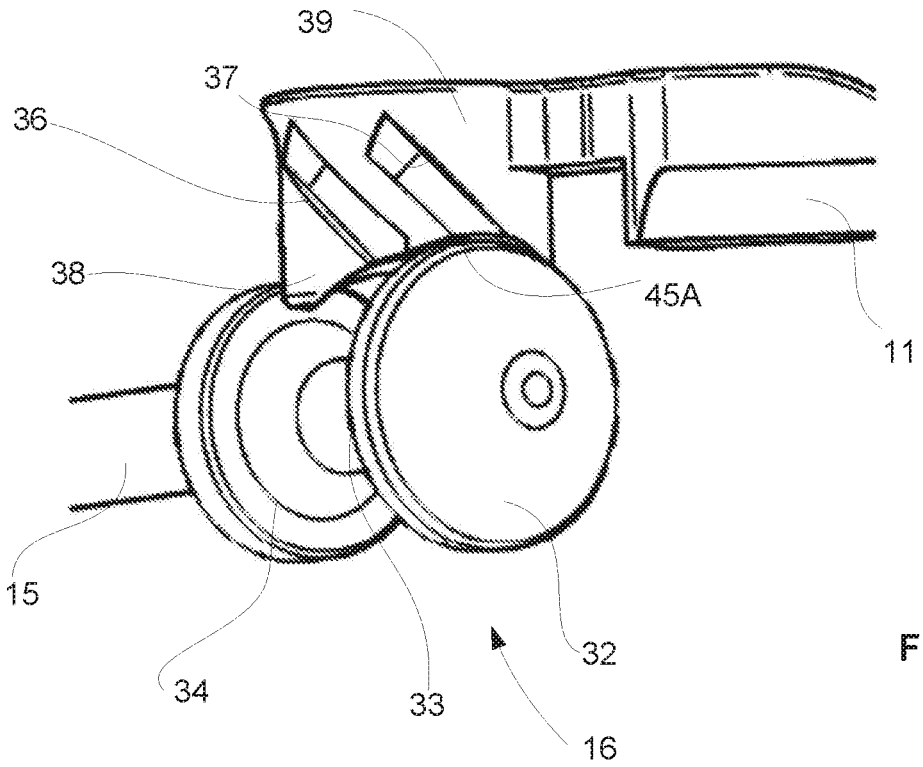

In FIG. 21 is shown the release position, in which the safety lever 11 actuated by the hammer 17 releases movement of the firing pin 15 towards the primer of the cartridge (not shown) but not from inside the bolt 18. The movement of the hammer 17 has moved the safety lever 11 to the release position, as the bearing surface 42 turns to side—to right in the example of the figure—and opens a form-fitting space by the release arch recess 45A for the first shoulder 32 to move and the firing pin can freely move forwards.

Figure 22:
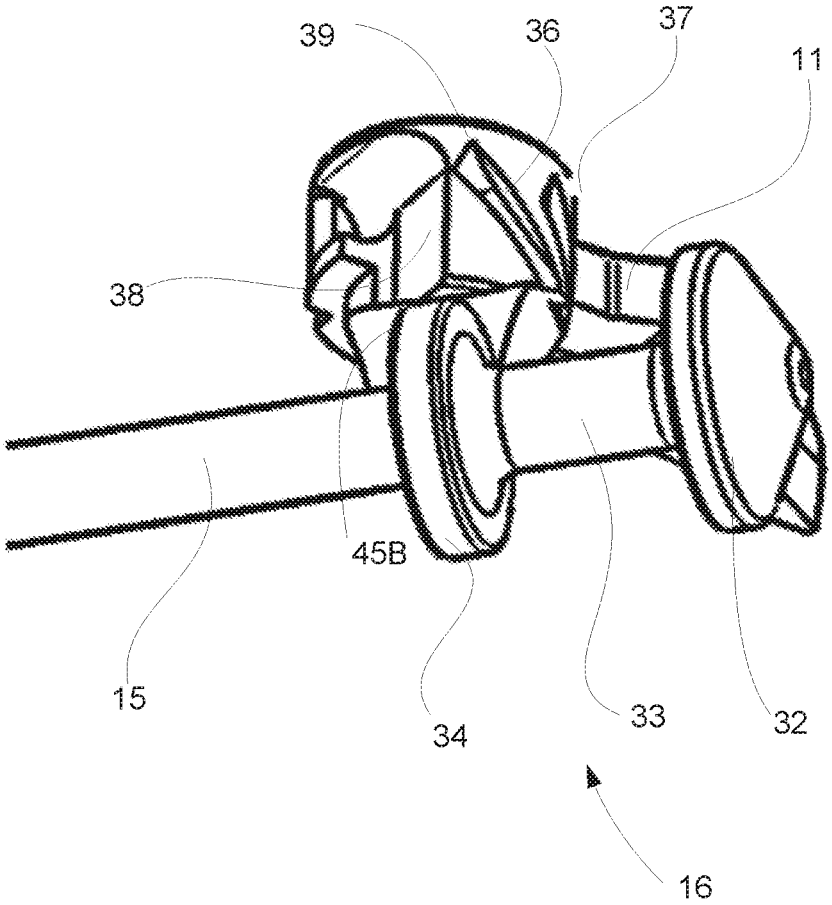
Figure 23:
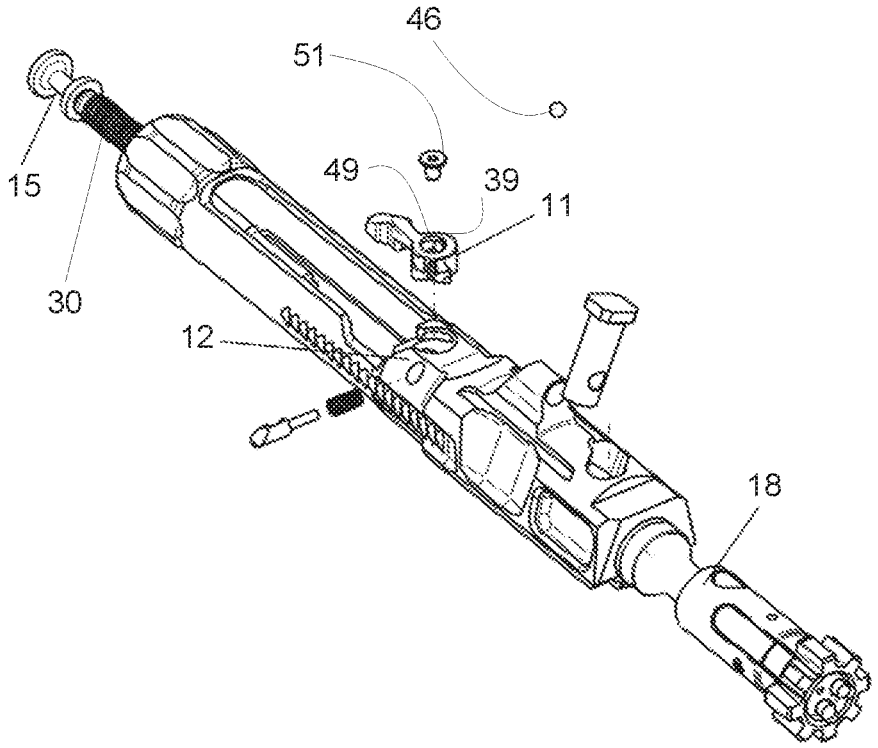
Figure 24:
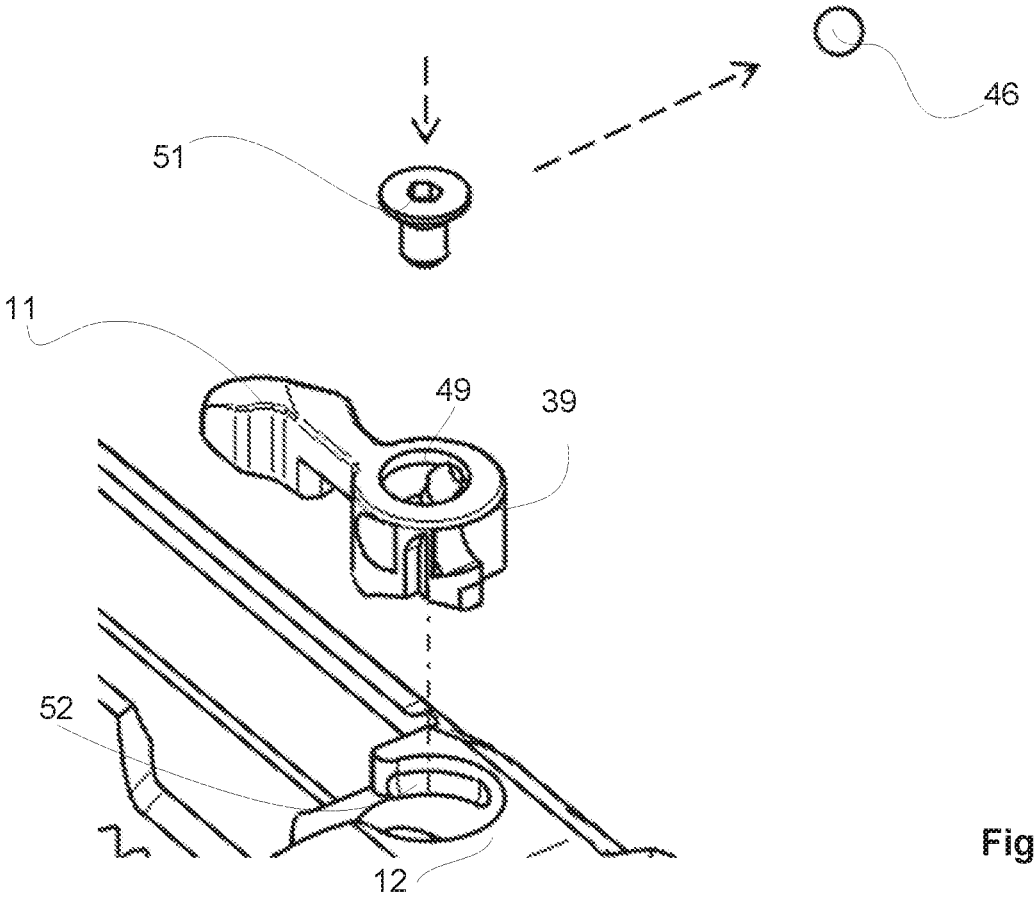

In FIG. 22 is shown the dismantle position, in which position the safety lever 11 of the firing pin safety 10 can be dismantled and the firing pin 15 can be removed manually from inside the bolt 18 of the firearm 100 without tools. The safety lever 11 is turned to its rightmost position, which releases the firing pin 15 as the dismantle arch recess 45B is positioned over the second shoulder 34 of the firing pin 15 and the firing pin 15 moves backwards by itself due to the spring-actuation by the spring 30 from below the body 39 of the safety lever 11 under the dismantle arch recess 45B.

Figure 25:
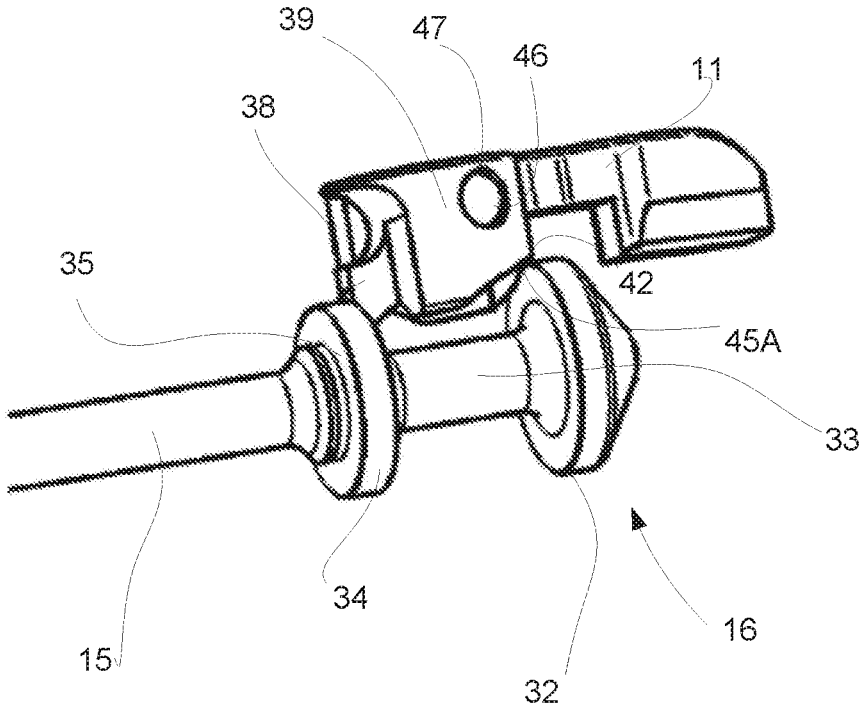
Figure 26:
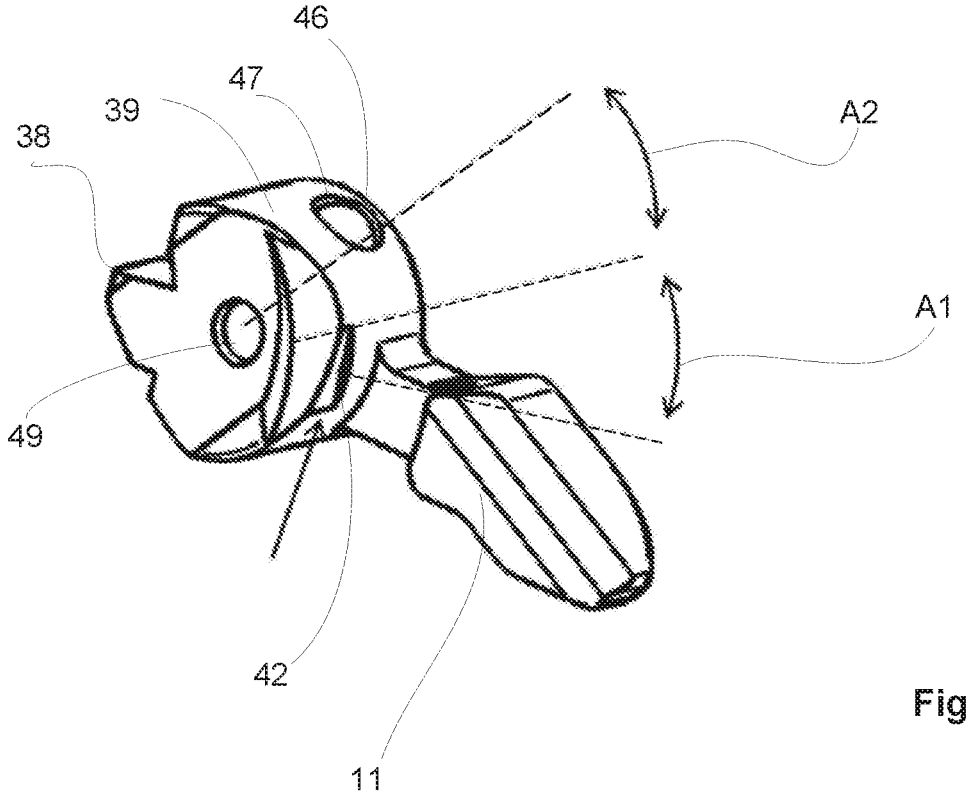

In FIGS. 23-28 is schematically shown another advantageous example of the form-fitting forms of the firing pin safety with safety lever locking means. In this example ball bearing locking means are provided, which comprise a ball 46, a hole 47 for the ball 46 and a counter sink locking screw 51. In this example turning the screw 51 drives the ball 46 out in radial direction and secures the safety lever 11 in vertical direction by means of a ball recess 52 in the bolt carrier 12. The return spring of the firing pin 15 is denoted by reference numeral 30. The body of the safety lever 11 is provided with the arch recesses 45A, 45B for release and dismantle and with the shoulder part 38 as well as a bearing surface 42. The firing pin 15 comprises the breech head 16 provided with the two shoulders 32, 34 and is also provided with a groove 35 for locking the spring 30 by attachment of the last loop of the spring 30 into the groove 35. By this the return-spring 30 is securely attached to the firing pin preventing accidental loss of the spring 30. The body 39 of the safety lever 11 is provided with a preferably threaded opening 49 for the screw 51. The turning movement of the safety lever 11 from the basic position to the release position and back is shown in FIG. 26 by arch A1 and from the release position to the dismantle position as indicated by arch A2.

In FIGS. 25-26 is shown the locking principle of the safety lever 11 in greater detail. In basic position the firing pin 15 is fully secured within the form-fitting forms provided by the shoulder part 38 of the body 39 of the safety lever 11 and the second shoulder 34 of the breech head 16 of the firing pin 15 as well as by the release arch recess 45A not exceeding the first shoulder 32 prevented by means of the bearing surface 42, which prevent movements towards back or front and thus the firing pin 15 cannot contact the primer and danger of slam-fire is prevented.

Figure 27:
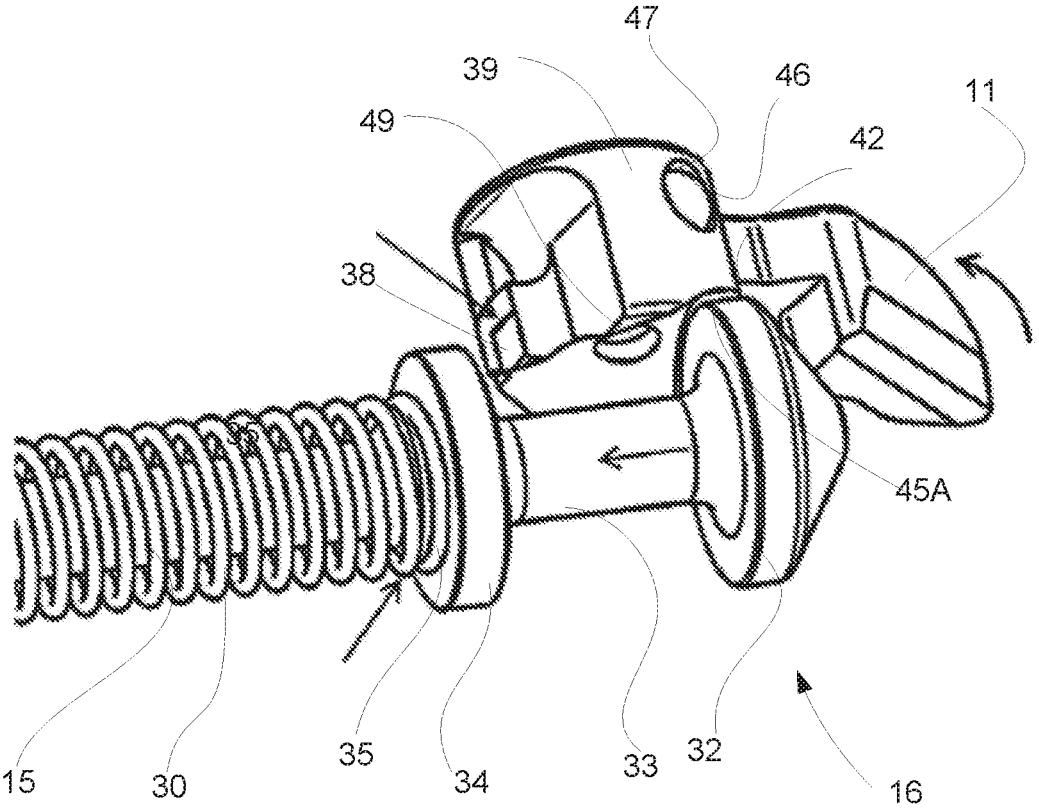

In the release position, the firing pin 15 shown in FIG. 27 can reach the primer once hit by the hammer 17. The firing pin 15 is still secured inside the bolt carrier 12 by means of the shoulder part 38. In the dismantle position the manual, tool-less removal of the firing pin 15 is provided.

Figure 28:
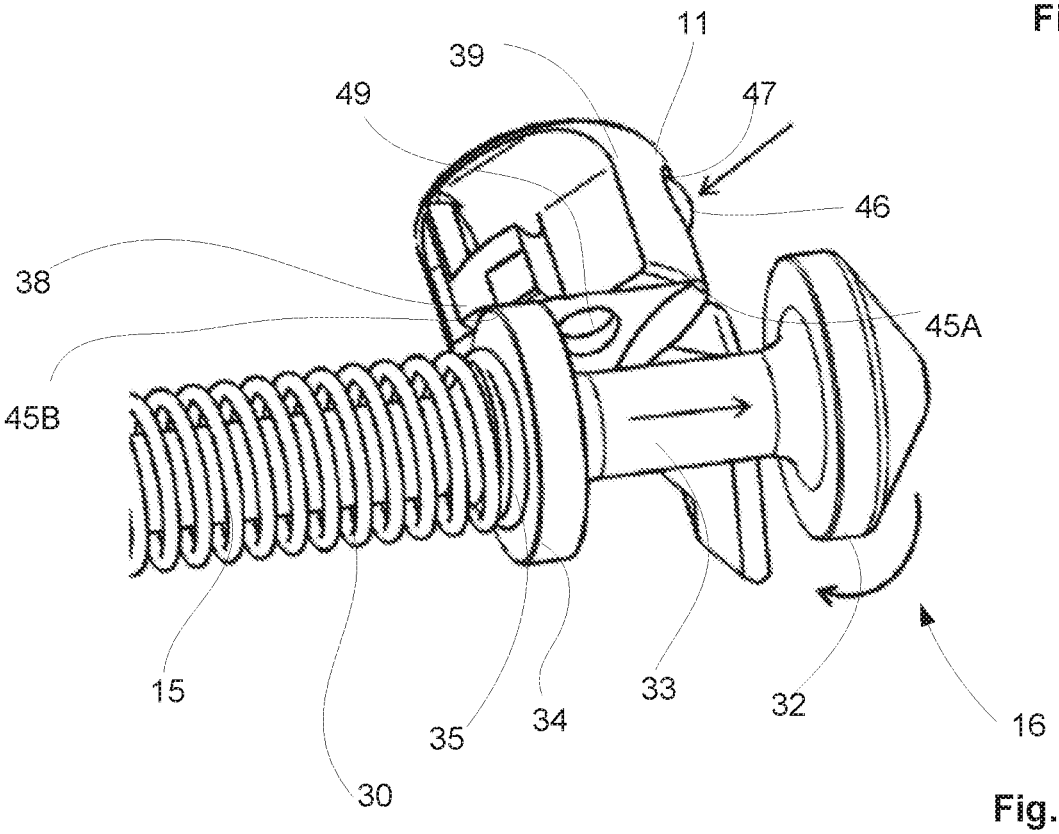

In the FIG. 28 is shown the safety lever 11 in its dismantle position, in which when the bolt carrier 12 has been removed from the firearm 100, the safety lever 11 can be manually turned into the dismantle position and the spring-loaded firing pin 15 is being released to the rear.

In the description in the foregoing, although some functions and elements have been described with reference to certain features and examples, those functions and elements may be performable by other features and examples whether described or not. Although features have been described with reference to certain embodiments or examples, those features may also be present in other embodiments or examples whether described or not.

Above only some advantageous examples of the inventions have been described to which examples the invention is not to be narrowly limited and many modifications and alterations are possible within the invention.

REFERENCE SIGNS USED IN THE DRAWING

10 firing pin safety
11 safety lever
12 bolt carrier
15 firing pin
16 breech head
17 hammer
18 bolt
19 bevel
24 spring-loaded return plunger
25 spring-loaded plunger
26 beveled surface
30 spring
31 upper body
32 shoulder
33 recess
34 shoulder
35 groove for locking the spring
36 groove for dust/dirt removal
37 groove for dust/dirt removal
38 shoulder part

39 body
42 bearing surface
45A release arc recess
45B dismantle arc recess
46 ball
47 hole
49 opening
51 screw
52 ball recess
100 firearm

The invention claimed is:

1. A firing pin safety of a firearm
comprising a safety lever mounted on a bolt carrier of the firearm, and being configured to control a movement of a firing pin of the firearm, wherein
the safety lever of the firing pin safety and a hammer of the firearm are integrated functionally,
the safety lever is turnable and has three main positions:
a basic position, in which position the safety lever of the firing pin safety prevents a forward movement of the firing pin of the firearm toward a primer of a cartridge and a movement of the firing pin from extending beyond inside a bolt of the firearm,
a release position, in which position the safety lever actuated by the hammer of the firearm releases movement of the firing pin of the firearm forward towards the primer of the cartridge but prevents a movement of the firing pin from extending beyond inside the bolt of the firearm, and
a dismantle position, in which position the safety lever of the firing pin safety can be dismantled and the firing pin of the firearm can be removed manually from inside the bolt of the firearm without tools.

2. The firing pin safety according to claim 1, wherein the safety lever of the firing pin safety is configured to be guided by a spring-loaded plunger of the hammer of the firearm.

3. The firing pin safety according to claim 1, wherein the safety lever of the firing pin safety is configured to be guided by a beveled surface of the hammer of the firearm.

4. The firing pin safety according to claim 1, wherein the safety lever comprises a bevel configured to provide turning of the safety lever.

5. The firing pin safety according to claim 1, wherein the firing pin comprises a breech head and the safety lever has form-fitting forms that correspond to form-fitting forms of the breech head of the firing pin configured to affect degrees of freedom of the firing pin subject to the position of the safety lever.

6. The firing pin safety according to claim 5, wherein the form-fitting forms of the safety lever comprise arch recesses and a shoulder part as well as a bearing surface, and the form-fitting forms of the breech head of the firing pin comprise two shoulders and a recess between the shoulders.

7. The firing pin safety according to claim 1, wherein the firing pin safety comprises a spring-loaded return plunger for returning the safety lever automatically to its basic position.

8. The firing pin safety according to claim 7, wherein the return plunger is locking the safety lever to the bolt carrier.

9. The firing pin safety according to claim 1, wherein the firing pin safety comprises ball bearing locking means configured to secure the safety lever in vertical direction by means of a ball recess in the bolt carrier.

10. The firing pin safety according to claim 1, wherein the firing pin safety comprises a return-spring for the firing pin and the firing pin comprises a groove for locking the spring by attachment of a last loop of the spring into the groove.

11. The firing pin safety according to claim 1, wherein the safety lever of firing pin safety comprises a body provided with at least one on its outer surface extending inclined groove for dirt and/or dust removal.

* * * * *